US006378800B1

(12) United States Patent
Apichom

(10) Patent No.: US 6,378,800 B1
(45) Date of Patent: Apr. 30, 2002

(54) PAPER HOLDING DEVICE

(76) Inventor: Surasak Apichom, 2125 Ohio Ave., #G, Signal Hill, CA (US) 90804

( * ) Notice: Subject to any disclaimer, the term of this patent is extended or adjusted under 35 U.S.C. 154(b) by 0 days.

(21) Appl. No.: 09/753,639

(22) Filed: Jan. 2, 2001

(51) Int. Cl.[7] ..... B65H 19/00
(52) U.S. Cl. ..... 242/560; 242/594.5
(58) Field of Search ..... 242/560, 560.2, 242/594, 594.4, 594.5, 594.6, 598.1, 598.4, 598.3, 596.1, 596.2, 596.7, 599.1; D6/520; 248/309.2, 905

(56) References Cited

U.S. PATENT DOCUMENTS

| | | | | | |
|---|---|---|---|---|---|
| 2,549,912 | A | * | 4/1951 | Lindsay | 242/598.4 |
| 2,685,365 | A | | 8/1954 | Sieven | |
| 2,790,608 | A | | 4/1957 | Sieven | |
| 3,038,677 | A | * | 6/1962 | Schermerhorn | 242/594.5 |
| 3,297,265 | A | * | 1/1967 | Turro | 242/599.1 |
| 3,335,973 | A | | 8/1967 | Genn | |
| 3,824,953 | A | * | 7/1974 | Boone | 242/560 |
| 3,830,198 | A | * | 8/1974 | Boone | 242/560 |
| 3,837,595 | A | | 9/1974 | Boone | |
| 5,012,986 | A | | 5/1991 | Needle | |
| D406,481 | S | | 3/1999 | Conrado | |
| 5,897,074 | A | * | 4/1999 | Marino | 242/594.5 |
| 6,056,233 | A | | 5/2000 | Von Schenk | |

* cited by examiner

*Primary Examiner*—William A. Rivera
(74) *Attorney, Agent, or Firm*—Eric Karich

(57) ABSTRACT

A paper holding device for holding at least two rolls of paper has a first roll carrying assembly and a second roll carrying assembly, the first and second roll carrying assemblies including first and second pegs that enable either of the first or second roll carrying assemblies is mountable upon a paper holding bracket. The first or second roll carrying assemblies are connected by first and second support arms that removably engage a groove in the first and second pegs. When the first roll carrying assembly is mounted on the paper holding bracket, the first and second support arms support the second roll carrying assembly in an orientation that is generally horizontal, such that the first and second roll carrying assembles are useful for supporting and dispensing, together, at least two rolls of paper.

4 Claims, 5 Drawing Sheets

PAPER HOLDING DEVICE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to paper holding devices, and more particularly to a paper holding device that simultaneously dispenses two rolls of paper.

2. Description of Related Art

The prior art has shown various toilet paper holders that enable a second roll of toilet paper to be mounted in proximity to a first roll of toilet paper.

Conrado, U.S. Des. Pat. No. 406,481, teaches a hanger for a second roll of toilet paper. The hanger shown in Conrado uses a pair of support arms that have hooks at either end, the hooks being useful for hanging a second toilet paper spindle from a first toilet paper spindle. The loose connection between the support arms and the first and second toilet paper spindles is partially stabilized through the inclusion of a horizontal support member that rigidly connects the middle of each of the pair of support arms.

Sieven, U.S. Pat. Nos. 2,685,365 and 2,790,608, teach a supporting bracket for mounting a replacement tissue roll onto a pre-existing toilet paper spindle. The supporting bracket includes a pair of support arms that hook over the pre-existing toilet paper spindle and are held in place by gravity. The support arms are similar to the support arms of Conrado. Boone, U.S. Pat. No. 3,837,595, teaches a supplemental sheet-dispensing device for a toilet tissue dispenser. The Boone device also hangs from support arms that merely hook over the pre-existing toilet paper spindle, similar to Conrado. The Boone device includes a pair of opposing compression springs, one at the end of either support arm, to clamp the second roll of toilet paper.

Genn, U.S. Pat. No. 3,335,973, teaches a paper dispensing machine that includes a pair of pivot arms to alternatively dispense a pair of rolls of toilet paper.

Needle, U.S. Pat. No. 5,012,986, teaches a spare toilet tissue holder in which a second toilet paper spindle is supported by support arms connected to an auxiliary spindle that is positioned through the core of the original roll of toilet paper, the original roll of toilet paper being mounted on a first toilet paper spindle that is mounted on the traditional support bracket.

Von Schenk, U.S. Pat. No. 6,056,233, teaches a protective housing for bathroom toilet paper, the protective housing having spring biased spindles that mount into brackets that are attached to a wall of a bathroom stall. While generally similar in structure to the structure used in the present invention, the spindle does not include the flange/groove structure, described below, that enables the proper function of the present invention.

The prior art teaches various devices for mounting a second roll of toilet paper in proximity to a first roll of toilet paper. However, the prior art does not teach a paper holding device having first and second roll carrying assemblies with first and second pegs at either end that enable either of the first or second roll carrying assemblies to be mountable upon a paper holding bracket, the first and second pegs each providing a groove and a flange that allows the first and second roll carrying assemblies to be firmly interconnected by first and second support arms that removably engage the grooves of the first and second pegs. The present invention fulfills these needs and provides further related advantages as described in the following summary.

SUMMARY OF THE INVENTION

The present invention teaches certain benefits in construction and use which give rise to the objectives described below.

The present invention provides a paper holding device for holding at least two rolls of paper. The paper holding device includes a first roll carrying assembly and a second roll carrying assembly, the first and second roll carrying assemblies including first and second pegs that enable either of the first or second roll carrying assemblies is mountable upon a paper holding bracket. The first or second roll carrying assemblies are connected by first and second support arms that removably engage a groove in the first and second pegs. When the first roll carrying assembly is mounted on the paper holding bracket, the first and second support arms support the second roll carrying assembly in an orientation that is generally horizontal, such that the first and second roll carrying assembles are useful for supporting and dispensing, together, at least two rolls of paper.

A primary objective of the present invention is to provide a paper holding device having advantages not taught by the prior art.

Another objective is to provide a paper holding device having first and second roll carrying assemblies for dispensing at least two rolls of paper, the second roll carrying assembly being attached to the first roll carrying assembly with first and second support arms that firmly clip onto a groove located on first and second pegs located on either end of the first and second roll carrying assemblies.

A further objective is to provide a flange adjacent the groove of each of the first and second pegs, the flange serving to secure in place a hooked locking end of its respective support arm, thereby preventing the hooked locking end from falling off the peg.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
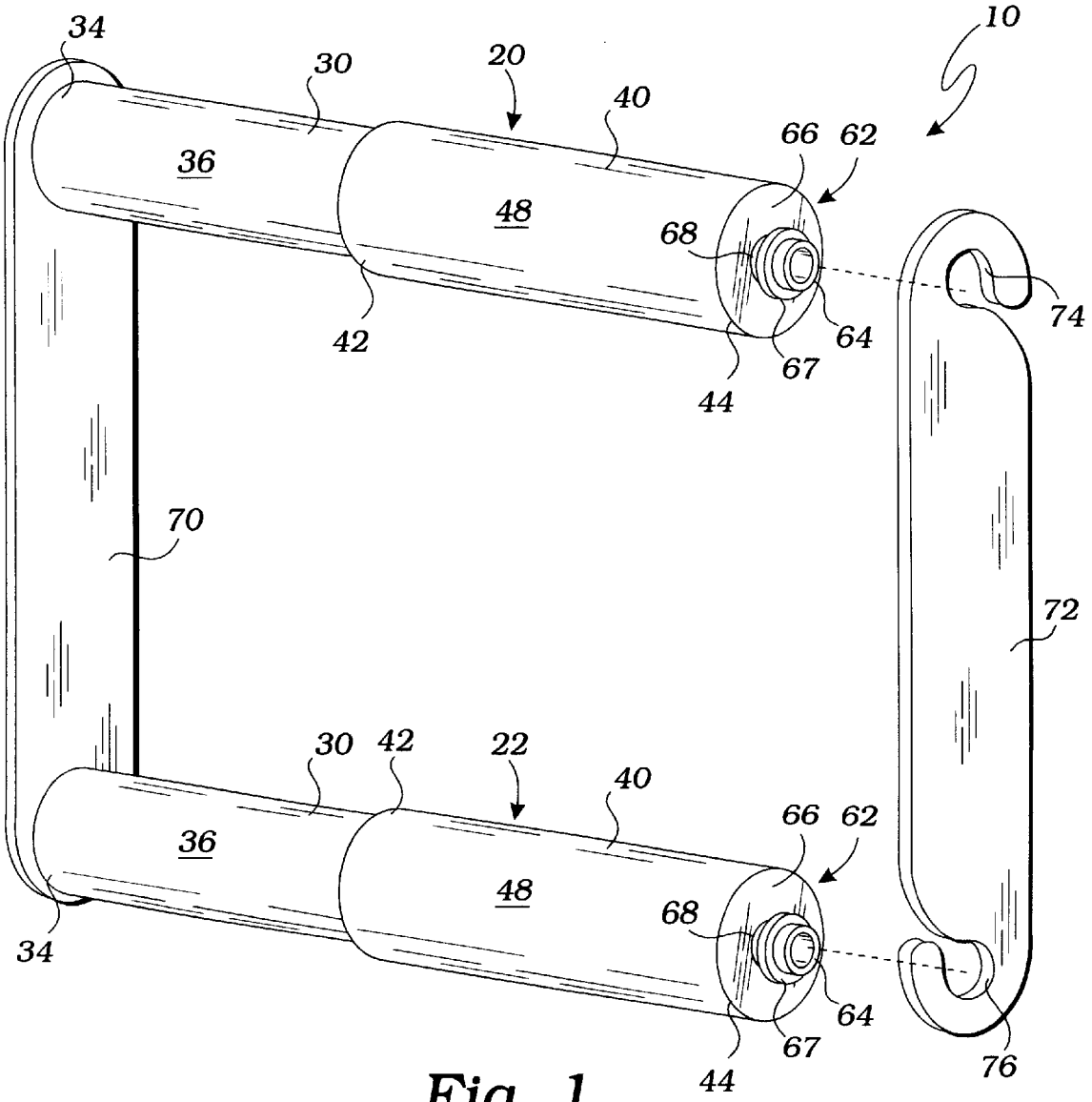
FIG. 1 is a perspective, partially exploded view of the preferred embodiment of the present invention, a paper holding device.

The above described drawing figures illustrate the invention, a paper holding device 10 for holding at least two rolls of paper 12. The paper holding device 10 includes a first roll carrying assembly 20 and a second roll carrying assembly 22, the first and second roll carrying assemblies 20 and 22 including first and second pegs 60 and 62 that enable either of the first or second roll carrying assemblies 20 or 22 is mountable upon a paper holding bracket 14. The first or second roll carrying assemblies 20 and 22 are connected by first and second support arms 70 and 72 that removably engage a groove 68 in the first and second pegs 60 and 62. When the first roll carrying assembly 20 is mounted on the paper holding bracket 14, the first and second support arms 70 and 72 support the second roll carrying assembly 22 in an orientation that is generally horizontal, such that the first and second roll carrying assembles 20 and 22 are useful for supporting and dispensing, together, the at least two rolls of paper 12. Additional roll carrying assembles, not shown, can be added in a daisy-chain fashion, to increase the number of rolls of paper that are dispensed.

As shown in FIGS. 1–6, each of the first and second roll carrying assemblies 20 and 22 includes a smaller sleeve 30 and a larger sleeve 40. The smaller sleeve 30 has a smaller inner end 32, a smaller outer end 34, a smaller outer surface 36, and a smaller inner surface 38. The larger sleeve 40 has a larger inner end 42, a larger outer end 44, a larger inner surface 46, and a larger outer surface 48. The smaller inner end 32 fits within and telescopically engages the larger inner end 42. Both the smaller and larger sleeves 30 and 40 are preferably cylindrical in shape and constructed of either molded plastic, a decorative metal such as brass, bronze, or stainless steel, or a molded plastic painted with an imitation metal coating.

Figure 4:
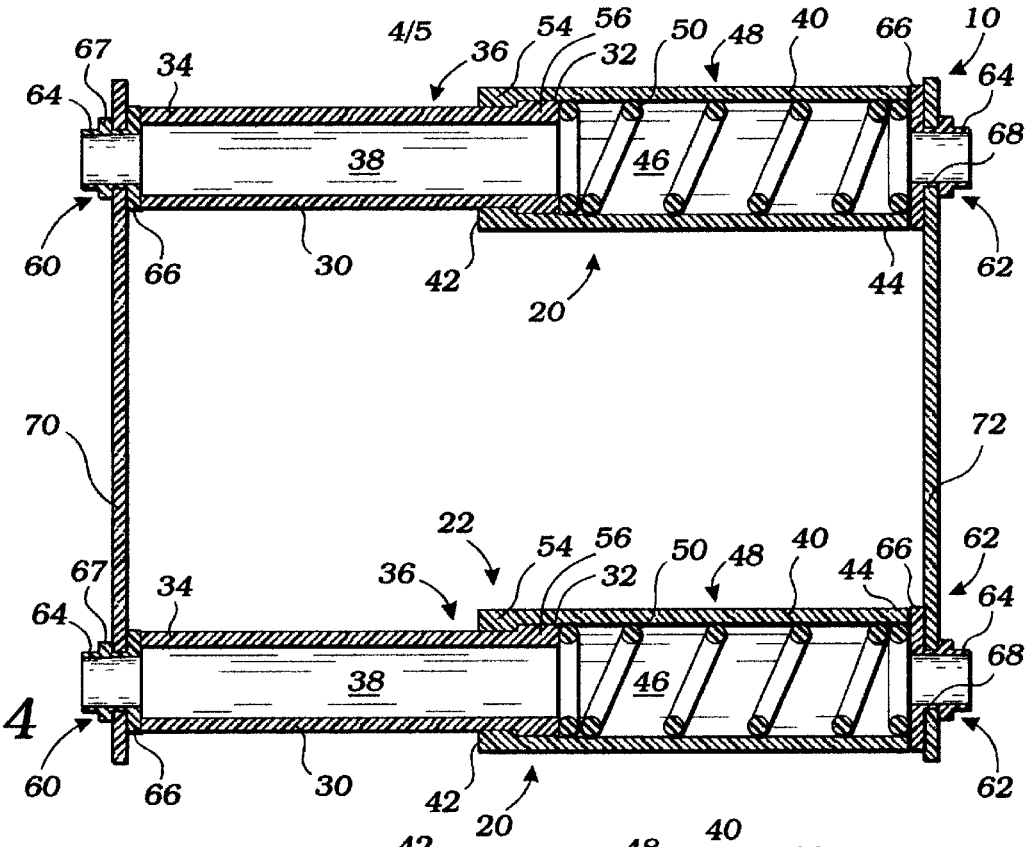
FIG. 4 is a sectional view thereof taken along line 4—4 in FIG. 2.
Figure 5:
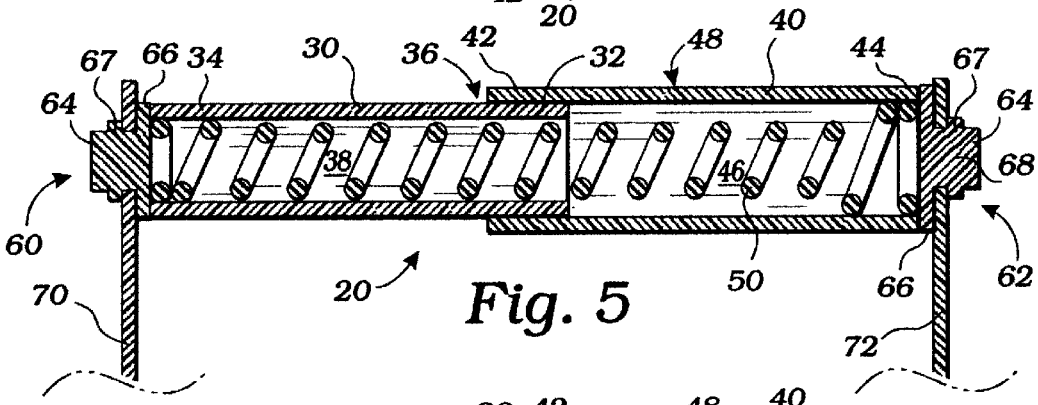
FIG. 5 is a sectional view of an alternative embodiment of a first roll carrying assembly attached to first and second support arms.
Figure 6:
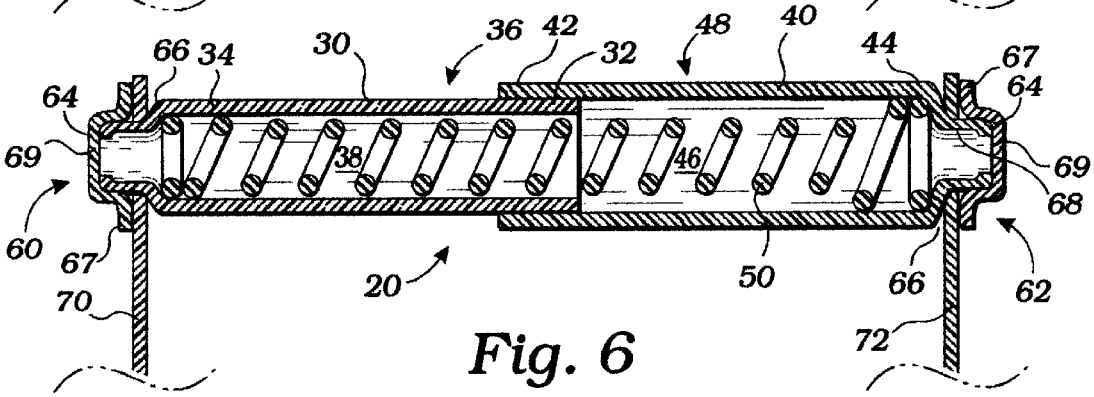
FIG. 6 is a sectional view of another alternative embodiment of the first roll carrying assembly.

As shown in FIGS. 4–6, each of the first and second roll carrying assemblies 20 and 22 includes a means for biasing the smaller sleeve 30 away from the larger sleeve 40, as well as a means for securing the smaller sleeve 30 within the larger sleeve 40 so that the means for biasing does not push the smaller sleeve 30 out of the larger sleeve 40. As shown in FIG. 4, in a first embodiment the means for biasing includes a compression spring 50 positioned within the larger sleeve 40, and the means for securing includes a first ridge 54 on the larger inner surface 46 of the larger sleeve 40, and a second ridge 56 on the smaller outer surface 36 of the smaller sleeve 30. The compression spring 50 is positioned to abut the smaller inner end 32 of the smaller sleeve 30 and the base 66 of the second peg 62 attached to the larger outer end 44 of the larger sleeve 40. In this position, the compression spring 50 biases the smaller outer end 34 away from the larger outer end 44 until the first ridge 54 frictionally engages the second ridge 56. The first and second ridges 54 and 56 cooperate to prevent the smaller sleeve 30 from falling out of the larger sleeve 40 under the bias of the compression spring 50.

In another alternative embodiment, as shown in FIGS. 5 and 6, both the means for biasing and the means for securing are provided by a compression spring 50 positioned within and extending across both the smaller and larger sleeves 30 and 40. The compression spring 50 is positioned to bias the smaller outer end 34 away from the larger outer end 44, preferably by abutting the bases 66 of the first and second pegs 60 and 62. The compression spring 50 is also shaped to frictionally engage both the smaller inner surface 38 of the smaller sleeve 30 and the larger inner surface 46 of the larger sleeve 40. Thus positioned, the compression spring 50 frictionally prevents the smaller sleeve 30 from falling out of the larger sleeve 40.

As shown in FIGS. 1–6, each of the first and second roll carrying assemblies 20 and 22 further have a first peg 60 and a second peg 62. The first and second pegs 60 and 62 are critical, providing attachment points for both the paper holding bracket 14 and the first and second support arms 70 and 72. The first and second pegs 60 and 62 each have a bracket engagement tip 64, and at least one and preferably both include a base 66, a flange 67 extending outwardly and circumferentially between the base 66 and the bracket engagement tip 64, and a groove 68 formed between the base 66 and the flange 67. The flange 67 and the groove 68 are critical to the proper attachment of the second support arm, as described in greater detail below. In the first embodiment, both the first and second pegs 60 and 62 and the first and second support arms 70 and 72 are identical; however, since only one of the support arms 70 or 72 must be capable of being removably attached to its roll carrying assembly 20 or 22, one of the attachments can be a simpler and more permanent connection that can readily be devised by those skilled in the art.

Figure 3:
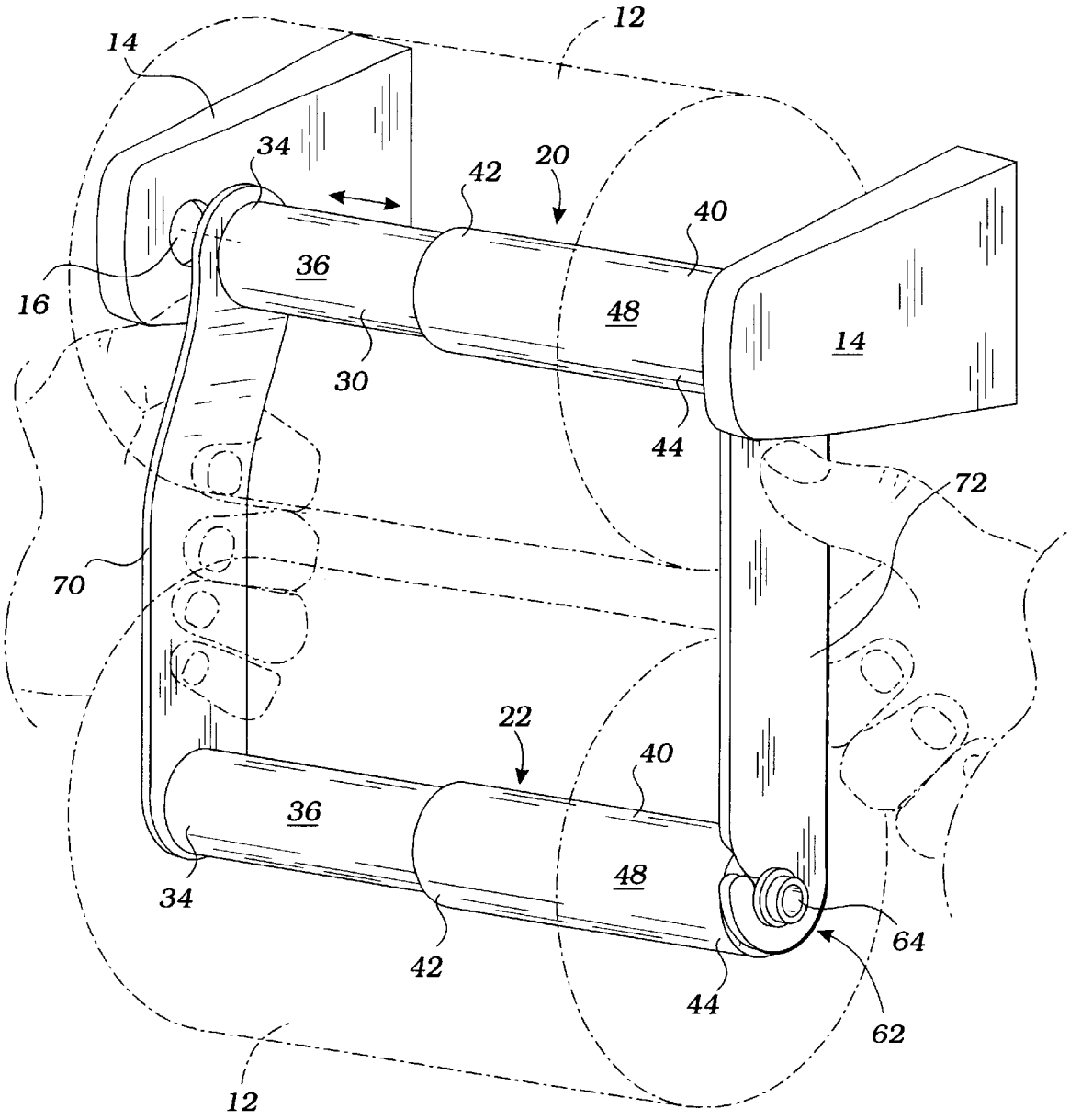
FIG. 3 is a perspective view thereof illustrating how the paper holding device is mounted upon a paper holding bracket.

In a first embodiment, as shown in FIGS. 4 and 5, the first and second pegs 60 and 62 are molded plastic parts that are attached to the smaller and larger outer ends 34 and 44 of each of the first and second roll carrying assemblies 20 and 22. In the preferred embodiment, each of the bases 66 is heat fused to the first and second roll carrying assemblies 20 and 22, although the bases 66 can also be attached with alternative means, such as adhesives, or they can be integrally molded as part of the first and second roll carrying assemblies 20 and 22. The bracket engagement tips 64 of the first and second pegs 60 and 62, in cooperation with the compression spring 50, being disposed relative to one another to make either the first or second roll carrying assemblies 20 or 22 mountable upon the paper holding bracket 14. As shown in FIG. 3, the compression spring 50 biases the first and second pegs 60 and 62 outwardly so that the bracket engagement tips 64 engage a pair of opposing mounting bores 16 of the paper holding bracket 14.

In an alternative embodiment, as shown in FIG. 6, the first and second pegs 60 and 62 are partially integral with the first and second roll carrying assemblies 20 and 22, and partially formed by a cap 69 that is attached to the smaller and larger outer ends 34 and 44 of each of the first and second roll carrying assemblies 20 and 22. The base 66 and the groove 68 of the first and second pegs 60 and 62 is formed by the smaller and larger outer ends 34 and 44 of each of the first and second roll carrying assemblies 20 and 22, while the flange 67 is formed by the cap 69. The advantage of the cap 69 is that it can readily be formed to provide a decorative appearance; however, it may sometimes be difficult to mount the paper holding device 10 on the paper holding bracket 14 if the cap 69 is too thick.

Figure 7:
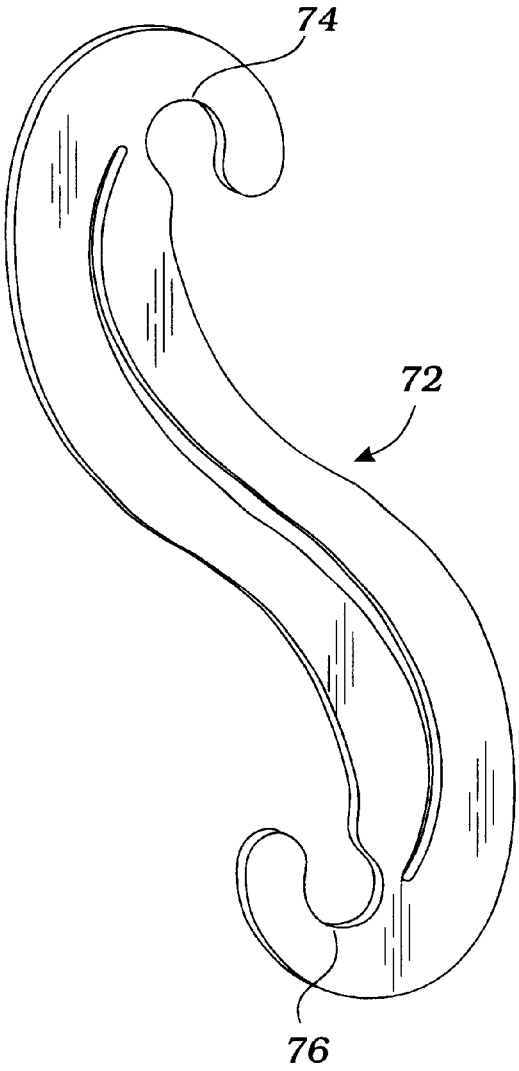
FIG. 7 is a perspective view of an alternative embodiment of the second support arm.
Figure 8:
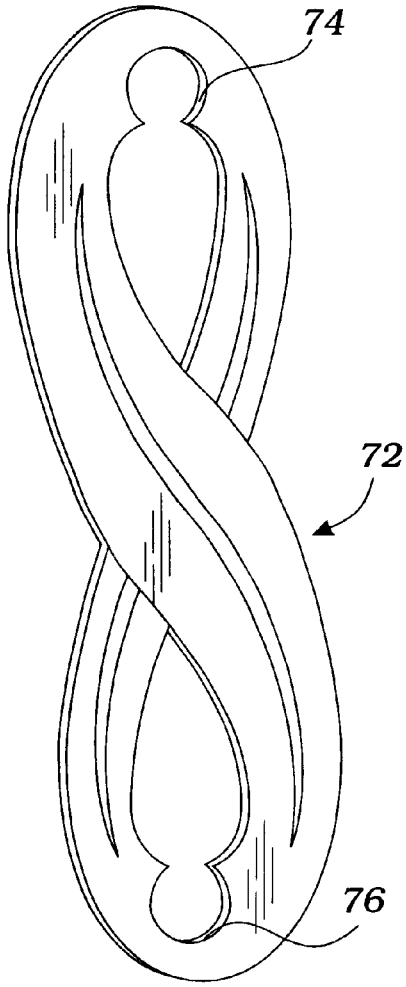
FIG. 8 is a perspective view of another alternative embodiment of the second support arm.

As shown in FIGS. 1–4, the first and second roll carrying assemblies 20 and 22 are connected by the first and second support arms 70 and 72. The first support arm 70 connects the groove 68 of the first peg 60 of the first roll carrying assembly 20 to the groove 68 of the first peg 60 of the second roll carrying assembly 22. To reduce manufacturing expenses, the first support arm 70 is the same as the second support arm 72, described below. However, since only one of the support arms 70 or 72 is required to be detachable, other structures are operable. The second support arm 72 has a first hooked locking end 74 and a second hooked locking end 76. Each of the first and second hooked locking ends 74 and 76 is shaped to removably lock onto the groove 68 of the second peg 62 of the first roll carrying assembly 20 and to the groove 68 of the second peg 62 of the second roll carrying assembly 22, thereby supporting the second roll carrying assembly 22 in a position that is generally horizontal and parallel to the first roll carrying assembly 20. As shown in FIGS. 7–8, the first and second support arms 70 and 72 preferably include various ornamental features to make the paper holding device 10 an attractive feature in a bathroom.

Figure 2:
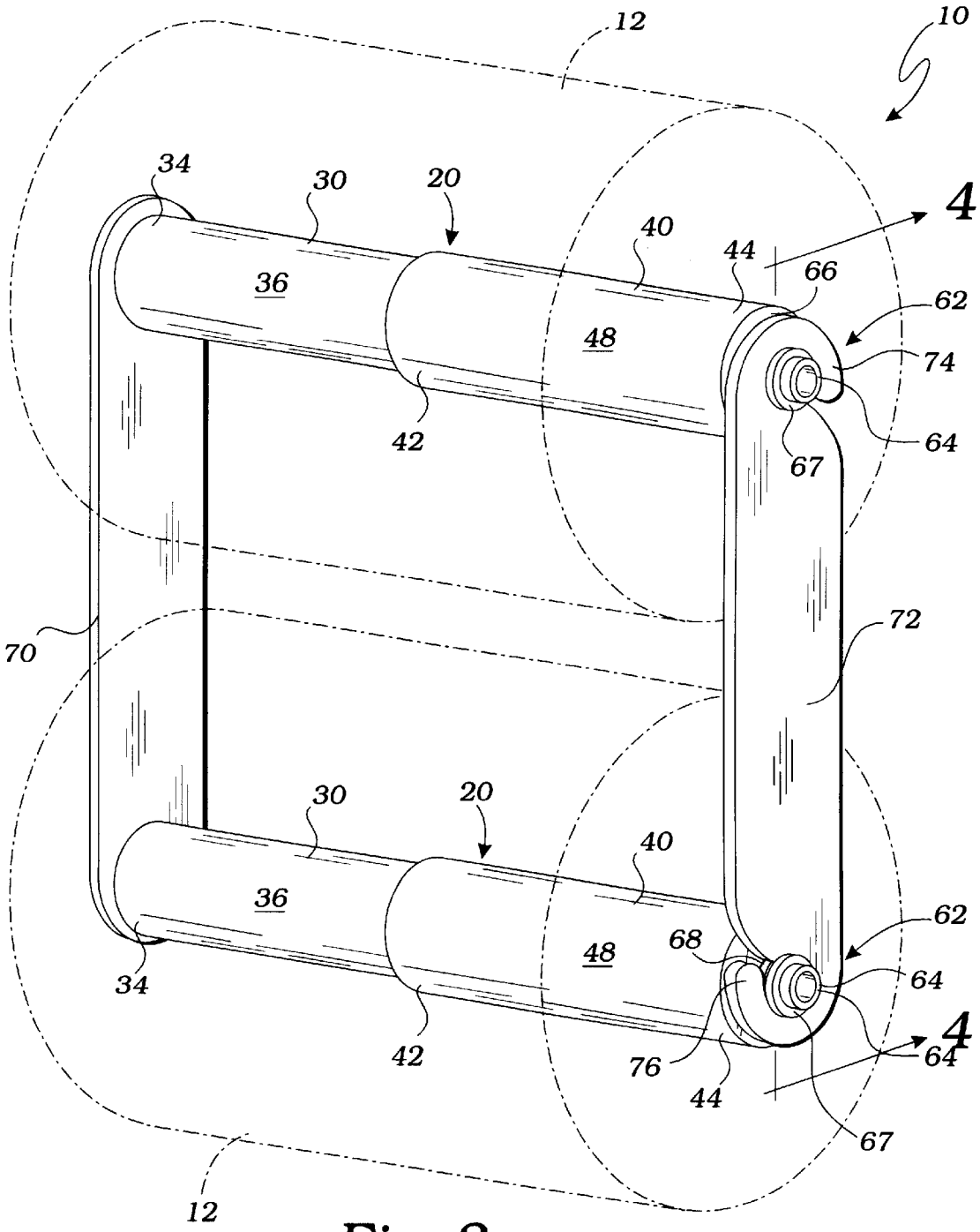
FIG. 2 is a perspective view thereof illustrating how two rolls of paper are mounted upon the paper holding device.

In use, the second support arm 72 is removable from the first and second roll carrying assemblies 20 and 22, as shown in FIG. 1, so that each of the at least two rolls of paper 12 can be mounted upon its respective roll carrying assembly 20 or 22. As shown in FIG. 2, the first and second roll carrying assemblies 20 and 22 are then connected by the second support arm 72. It is critical that the second support arm 72 snaps properly into the grooves 68 of each of the second pegs 62 so that the paper holding device 10 becomes a solid unit, with none of the components loose and prone to falling apart or being lost.

To mount the paper holding device 10 on the paper holding bracket 14, the user simply presses inwardly on both the first and second support arms 70 and 72, as shown in FIG. 3. Since the first and second support arms 70 and 72 are firmly attached to the smaller and larger outer ends 34 and 44 of the first and second roll carrying assemblies 20 and 22, the movement forces the smaller and larger sleeves 30 and 40 together against the bias of the compression spring 50, thereby allowing the bracket engagement tips 64 to be inserted between the pair of opposing mounting bores 16 of the paper holding bracket 14. When the user releases the inward pressure on the first and second support arms 70 and 72, the compression spring 50 again is able to bias the smaller and larger sleeves 30 and 40 apart and force the bracket engagement tips 64 to engage the pair of opposing mounting bores 16 of the paper holding bracket 14, thereby mounting the paper holding device 10 on the paper holding bracket 14 and allowing the use of the paper of the at least two rolls of paper 12.

When the at least two rolls of paper 12 are empty, the user simply reverses the above-described steps to remove the paper holding device 10 from the paper holding bracket 14. Once removed, the second support arm 72 is disengaged from the first and second roll carrying assemblies 20 and 22 by disengaging the first and second hooked locking ends 74 and 76 from the groove 68 of the second peg 62 of the first roll carrying assembly 20 and the groove 68 of the second peg 62 of the second roll carrying assembly 22. The empty cores of the at least two rolls of paper 12 are then readily removed and replaced by fresh rolls, and the paper holding device 10 is reassembled and remounted for further use.

While the invention has been described with reference to at least one preferred embodiment, it is to be clearly understood by those skilled in the art that the invention is not limited thereto. The paper holding device 10 has many components that can readily be inverted without altering the invention. Also, those skilled in the art will appreciate that additional roll carrying assemblies can be added, in a daisy-chain, to allow additional rolls of paper to be mounted on the paper holding bracket 14. Finally, it will be appreciated by those skilled in the art that the paper holding device 10 can be used to dispense many types of paper products, including, but not limited to, paper towels, baby wipes, and similar products, and should not be limited to the toilet paper products shown in drawings. The scope of the invention is to be interpreted only in conjunction with the appended claims.

What is claimed is:

1. A paper holding device for holding at least two rolls of paper, the paper holding device being mountable upon a paper holding bracket, the device comprising:

a first roll carrying assembly and a second roll carrying assembly, each of the first and second roll carrying assemblies having a smaller sleeve and a larger sleeve, the smaller sleeve having a smaller inner end and a smaller outer end, the larger sleeve having a larger inner end and a larger outer end, the smaller inner end fitting within and telescopically engaging the larger inner end;

each of the first and second roll carrying assemblies having a means for biasing the smaller sleeve away from the larger sleeve;

each of the first and second roll carrying assemblies further having a means for securing the smaller sleeve within the larger sleeve so that the means for biasing does not push the smaller sleeve out of the larger sleeve;

each of the first and second roll carrying assemblies further having a first peg and a second peg formed at the smaller and larger outer ends of each of the first and second roll carrying assemblies, each of the first and second pegs having a bracket engagement tip that are shaped to engage the paper holding bracket, the first and second pegs cooperating with the compression spring to make either the first or second roll carrying assemblies mountable upon the paper holding bracket;

at least one of the first and second pegs further having a base, a flange extending outwardly between the base and the bracket engagement tip, and a groove formed between the base and the flange;

a first support arm connecting the first peg of the first roll carrying assembly to the first peg of the second roll carrying assembly; and a second support arm having a first hooked locking end and a second hooked locking end, each of the first and second hooked locking ends being shaped to removably lock onto the groove of the second peg of the first roll carrying assembly and to the groove of the second peg of the second roll carrying assembly, thereby supporting the second roll carrying assembly in a position that is generally parallel to the first roll carrying assembly.

2. The paper holding device of claim 1 wherein the means for biasing includes a compression spring positioned within the larger sleeve; the means for securing includes a first ridge on a larger inner surface of the larger sleeve, and a second ridge on a smaller outer surface of the smaller sleeve; and the compression spring is positioned to abut the smaller inner end of the smaller sleeve and the base of the peg attached to the larger outer end of the larger sleeve, the compression spring thereby biasing the smaller outer end away from the larger outer end until the first ridge frictionally engages the second ridge, the first and second ridges cooperating to prevent the smaller sleeve from falling out of the larger sleeve under the bias of the compression spring.

3. The paper holding device of claim 1 wherein both the means for biasing and the means for securing are provided by a compression spring positioned within and extending across both the larger and smaller sleeves, the compression spring being positioned to bias the smaller outer end away from the larger outer end, the compression spring being shaped to frictionally engage both a smaller inner surface of the smaller sleeve and a larger inner surface of the larger sleeve, thereby preventing the smaller sleeve from falling out of the larger sleeve under the bias of the compression spring.

4. A paper holding device for holding at least two rolls of paper, the paper holding device being mountable upon a paper holding bracket, the device comprising:

a first roll carrying assembly and a second roll carrying assembly, each of the first and second roll carrying assemblies having a smaller sleeve and a larger sleeve, the smaller sleeve having a smaller inner end, a smaller outer end, and an outer surface, the larger sleeve having a larger inner end, a larger outer end, and an inner surface, the smaller inner end fitting within and telescopically engaging the larger inner end;

each of the first and second roll carrying assemblies further having a compression spring positioned within the larger sleeve, the compression spring being positioned to abut the smaller inner end of the smaller sleeve and thereby bias the smaller outer end away from the larger outer end until a first ridge on the inner surface frictionally engages a second ridge on the outer surface, the first and second ridges cooperating to prevent the smaller sleeve from falling out of the larger sleeve under the bias of the compression spring;

each of the first and second roll carrying assemblies further having a first peg and a second peg, the first and second pegs each having a base, a bracket engagement tip, a flange extending circumferentially between the base and the bracket engagement tip, and a groove formed between the base and the flange;

the first and second pegs being attached to the larger and smaller outer ends of each of the first and second roll carrying assemblies, the bracket engagement tips of the first and second pegs, in cooperation with the compression spring, being disposed relative to one another to make either the first or second roll carrying assemblies mountable upon the paper holding bracket;

a first support arm connecting the groove of the first peg of the first roll carrying assembly to the groove of the first peg of the second roll carrying assembly; and a second support arm having a first hooked locking end and a second hooked locking end, each of the first and second hooked locking ends being shaped to removably lock onto the groove of the second peg of the first roll carrying assembly and to the groove of the second peg of the second roll carrying assembly, thereby supporting the second roll carrying assembly in a position that is generally parallel to the first roll carrying assembly.

* * * * *